US005400635A

United States Patent [19]

Kawaguchi et al.

[11] Patent Number: 5,400,635

[45] Date of Patent: Mar. 28, 1995

[54] CAN FORMING APPARATUS

[75] Inventors: Akira Kawaguchi, Hyogo; Toshihiko Kawashima, Shiuoka, both of Japan

[73] Assignee: Mitsubishi Materials Corporation, Tokyo, Japan

[21] Appl. No.: 111,730

[22] Filed: Aug. 25, 1993

[30] Foreign Application Priority Data

| | | | |
|---|---|---|---|
| Aug. 25, 1992 | [JP] | Japan | 4-226250 |
| Aug. 27, 1992 | [JP] | Japan | 4-228944 |
| Aug. 27, 1992 | [JP] | Japan | 4-228945 |
| Aug. 27, 1992 | [JP] | Japan | 4-228946 |

[51] Int. Cl.[6] ..... B21D 24/16

[52] U.S. Cl. ..... 72/361; 72/349

[58] Field of Search ..... 72/347, 349, 361; 413/70, 76

[56] References Cited

U.S. PATENT DOCUMENTS

| | | | |
|---|---|---|---|
| 1,733,445 | 10/1929 | Burns | 72/361 |
| 4,061,012 | 12/1977 | Wessman | 72/361 |
| 4,928,511 | 5/1990 | Sirvet | 72/361 |
| 4,969,348 | 11/1990 | Clowes et al. | 72/361 |
| 4,996,865 | 3/1991 | Haulsee et al. | 72/349 |

*Primary Examiner*—Lowell A. Larson

*Attorney, Agent, or Firm*—Mark A. Catan; Thomas R. Morrison; Peter J. Gluck

[57] ABSTRACT

A can forming apparatus interposes a plurality of feed guides projecting part way into a path of feed of a can blank. The feed guides hold a leading can blank and embrace it in cooperating outer peripheral recesses to move the can blank into alignment with a die. Radially extended portions, continuous from the recesses, press the can blank downward after the can blank is released from the recesses. A pair of leaf springs or a pair of rollers temporarily hold the can blank before it is pressed downward by the radially extended portions of feed guides. An elongated punch is advanced into the die bore effect deep drawing and ironing of the can blank in the die bore thereby forming a can body. The punch is driven in reciprocating linear motion, supported on fluid bearings. Pressurized gas is admitted through the punch into the can body at a time in the can-forming cycle appropriate to remove the can from the punch. The pressurized gas separates the can body from the punch.

14 Claims, 16 Drawing Sheets

30
3
303a
302
A
300
301
121
302a
122
304
303
121a
120b
120c
120
120a
305
119
119a
118
126
126a
126b
118d
118
123
124
7a
7
127
115
117
125

CAN FORMING APPARATUS

BACKGROUND OF THE INVENTION

The present invention relates to a can forming apparatus and, more particularly, to a can forming apparatus in which a punch is reciprocatingly and linearly moved in a die bore to effect deep drawing and ironing (sometimes referred to as "DI processing") on a sheet of metal such as aluminum, steel or the like, thereby forming a metallic can.

Referring to FIG. 18, a feeding mechanism of the prior art for feeding a cup-shaped can blank into a typical can forming apparatus includes a feeding mechanism 2 feeding a cup-shaped blank C into a press 1. The press 1 effects deep drawing and ironing on the cup-shaped blank C to produce a finished cup. The feeding mechanism 2 has a chute 2*a* which holds a plurality of the can blanks C, and allows the can blanks to drop freely. A rod 2*c* disposed under the chute 2*a* is advanced and retracted by an actuator 2*b*. During operation, the rod 2*c* is advanced to force the can blank C, held on the lower end of the chute 2*a*, into the press 1. At the same time, the next blank C' behind the leading blank C is allowed to drop freely along the chute 2*a* to the lower end of the chute 2*a*, placing it in position for feeding into the press 1 by the next stroke of the rod 2*c*.

The conventional feeding mechanism described above requires the can blank to drop into position by gravity. Such operation not only produces a high level of noise, but is also likely to produce dents and scratches by collision of the can blank C with parts of the feeding mechanism.

OBJECTS AND SUMMARY OF THE INVENTION

It is an object of the invention to provide a can forming apparatus which overcomes the drawbacks of the prior art.

It is a further object of the invention to provide a can forming apparatus in which can blanks are fed smoothly, without requiring the can blanks to drop by gravity, and the attendant minimization of physical flaws, such as dents and scratches in the finished cans.

It is a further object of the invention to provide a can forming apparatus having fast operation and durability.

Briefly stated, the present invention provides a can forming apparatus interposing a plurality of feed guides projecting part way into a path of feed of a can blank. The feed guides hold a leading can blank and embrace it in cooperating outer peripheral recesses to move the can blank into alignment with a die. Radially extended portions, continuous from the recesses, press the can blank downward after the can blank is released from the recesses. A pair of leaf springs or a pair of rollers temporarily hold the can blank before it is pressed downward by the radially extended portions of the feed guides. An elongated punch is advanced into the die bore to effect deep drawing and ironing of the can blank in the die bore thereby forming a can body. The punch is driven in reciprocating linear motion, supported on fluid bearings. Pressurized gas is admitted through the punch into the can body at a time in the can-forming cycle appropriate to remove the can from the punch. The pressurized gas separates the can body from the punch.

The can forming apparatus includes a feeding mechanism for feeding a cup-shaped can blank into alignment with a die bore of a die. An elongated punch is advanced into the die bore to deeply draw and iron the can blank in the die bore, thereby forming a can body. The punch is driven by a punch driving mechanism which moves the punch in a reciprocating fashion. The punch is supported by a punch bearing mechanism which supports and guides the punch during the reciprocating linear motion. A gas discharge mechanism supplies gas through at least one gas blow-off hole in the punch to pneumatically separate the can body from the punch after the can body is drawn.

The feeding mechanism includes a pair of feed guides which temporarily hold the can blank during a downward feed and then feed it further downward. The feed guides have substantially circular contours which are partly positioned in the path of feed. The feed guides are rotatable in opposite directions about their axes. The feed guides contain recesses on parts of their peripheries which embrace the can blank and feed it along the path of feed as the feed guides are rotated. Radially extended portions of the feed guides 51*b*, 52*a* press the can blank away from the feed guides as it is released from the recesses upon further rotation of the feed guides. The feeding mechanism includes a pair of leaf springs or rollers opposite each other across the path of feed and downstream of the feed guides. The leaf springs or rollers are resiliently urged by an urging mechanism to project into the path of feed of the can blank so that the can blank is securely held by the feeding mechanism as it passes through the feeding mechanism. The leaf springs or rollers support the can blank as it is released from the feed guides and as the can blank is pressed by the radially extended portions of the feed guides away from the feed guides and along the feed path.

The punch driving mechanism includes an internally toothed ring gear with a pinion having a pitch circle diameter equal to the pitch circle radius of the ring gear. The pinion revolves along the inner periphery of the ring gear in mesh with the internal teeth of the ring gear. A pinion driving mechanism is connected to the pinion to rotate the pinion around the axis of the ring gear while simultaneously rotating the pinion about its own axis. Consequently a given point on the pitch circle of the pinion reciprocatingly and linearly move along a diametrical line of the ring gear. The punch is rotatably supported on a point on the pitch circle of the pinion and is thereby made to move in a reciprocating linear fashion. A fluid bearing mechanism supports and guides the punch. In the fluid bearing, fluid pressure is maintained between the punch and the punch supporting portion to prevent direct contact therebetween.

The gas discharge mechanism supplies gas to the gas blow-off hole(s) in the punch. A part of the gas discharge mechanism supplies the gas into a gas communication passage in a rotary member at a predetermined rotational angle of the rotary member. The rotation of the rotary member is synchronized with the movement of the punch. The gas is introduced through the gas communication passage and along the axis of the pinion to the interior of the supporting shaft on the pitch circle of the pinion. The gas passes from the shaft supporting means to the gas blow-off hole(s) in the punch within the formed can body. The pressure of the gas forces the formed can body from the end of the punch. The gas communication passage provides communication of gas pressure between the moving gas blow-off hole(s) in the punch and a stationary source of gas pressure. Gas pressure is supplied to the gas communication passage through a rotary element, synchronized with the motion of the punch, and held in sliding contact with the stationary source of gas pressure. The passage is made up of one or more additional elements, slidably connected to the rotary element and slidably connected to the gas blow off hole(s) in the punch. The passage includes means for communicating gas pressure to the gas blow-off hole. The rotary member rotates about the is of the ring gear. The stationary source of gas is held in sliding contact with the rotary element. Holes are included in the stationary source and the rotary member, which line up periodically as the rotary member rotates, so that gas is introduced into the rotary member at at least one predetermined angle of rotation.

Operation of the present invention in the several embodiments is as follows. In one embodiment, movement of a can blank introduced into the path of feed is temporarily halted upon contact with the outer peripheral contours of the feed guides. As the feed guides are rotated, the can blank is embraced and fed downward by the recesses on the peripheries of the feed guides. The downwardly fed can blank is then stopped by the pair of leaf springs or rollers, acted upon by the urging means. As the feed guides are further rotated, the radially extended portions of the feed guides on the peripheries of the feed guides press the can blank against the leaf springs or the rollers, so that the leaf springs or rollers are forced out of the path of feed against the urging force exerted by the urging means. The can blank being fed is set into the die bore in the die by means of the punch which is driven by the punch driving mechanism and supported and guided by the punch bearing mechanism, so that deep drawing and ironing may be performed on the can blank to form it into a can body. The gas supplying means provided on a stationary part of the apparatus supplies a gas through the gas blow-off hole(s) in the punch after completion of the deep drawing and ironing, thereby separating the can body from the end of the punch.

According to an embodiment of the present invention there is provided a feeding mechanism for feeding can blanks into alignment with a die bore of a can forming apparatus, comprising: a stationary frame, a plurality of feed guides, each having an axis, rotatably attached to the stationary frame, means, attached to the stationary frame, for rotating the plurality of feed guides about respective ones of the axes of the feed guides, and the feed guides including means for consecutively holding, feeding, and releasing the can blank.

According to another embodiment of the invention, a can forming apparatus for deep drawing and ironing of a can blank comprising: a stationary frame, a plurality of feed guides, each having an axis, rotatably attached to the stationary frame, means, attached to the stationary frame, for rotating the plurality of feed guides about respective ones of the axes of the feed guides, the plurality of feed guides including means for consecutively holding, feeding, and releasing the can blank, the plurality of feed guides further including means for placing the can blank in axial alignment with a die bore, a punch, and means for producing reciprocating linear motion of the punch into the die bore to effect deep drawing and ironing on the can blank in the die bore.

According to yet another embodiment of the invention, there is provided, a can forming apparatus comprising: a punch, the punch including at least one blow-off hole, the punch being movably supported by a fluid bearing a pinion gear having a first axis, a ring gear having internal teeth, the ring gear having a second axis, the pinion gear having a pitch circle diameter, the ring gear having a pitch circle radius, the pitch circle diameter being equal to the pitch circle radius, means for revolving the pinion gear along an inner periphery of the ring gear in meshing engagement with the internal teeth of the ring gear, and means for rotatably supporting the punch on a point on the pitch circle diameter of the pinion gear.

According to still another embodiment of the invention, there is provided a can forming apparatus comprising: a punch, the punch being movably supported by a fluid bearing, a pinion gear having a first axis, a ring gear having internal teeth, the ring gear having a second axis, the pinion gear having a pitch circle diameter, the ring gear having a pitch circle radius, the pitch circle diameter being equal to the pitch circle radius, means for revolving the pinion gear along an inner periphery of the ring gear in meshing engagement with the internal teeth of the ring gear, means for slidably supporting the punch, and means for rotatably supporting the punch on a point on the pitch circle diameter of the pinion.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 0:
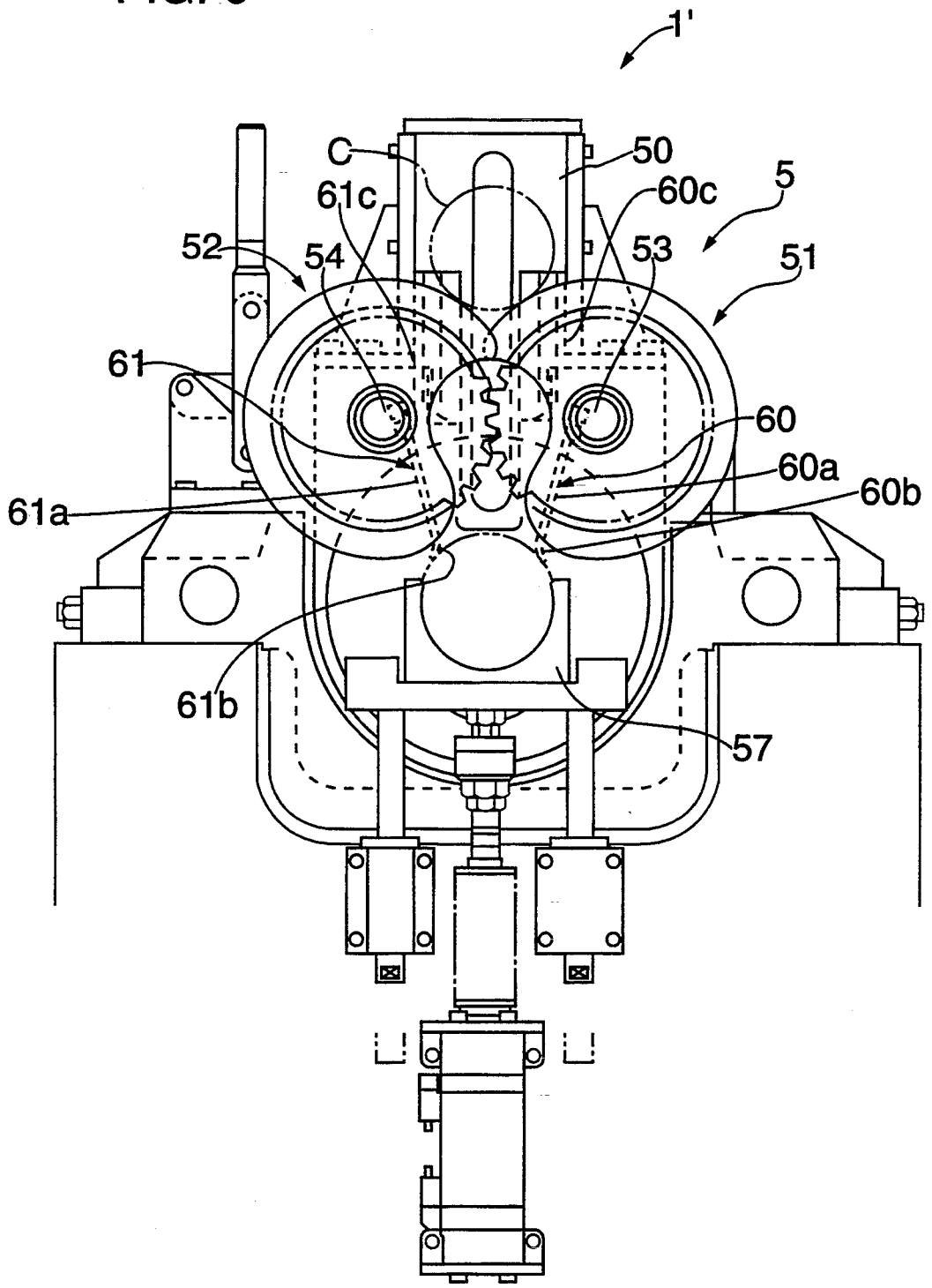
FIG. 0 is a front view of a feeding mechanism according to an embodiment of the present invention which employs leaf springs.
Figure 11:
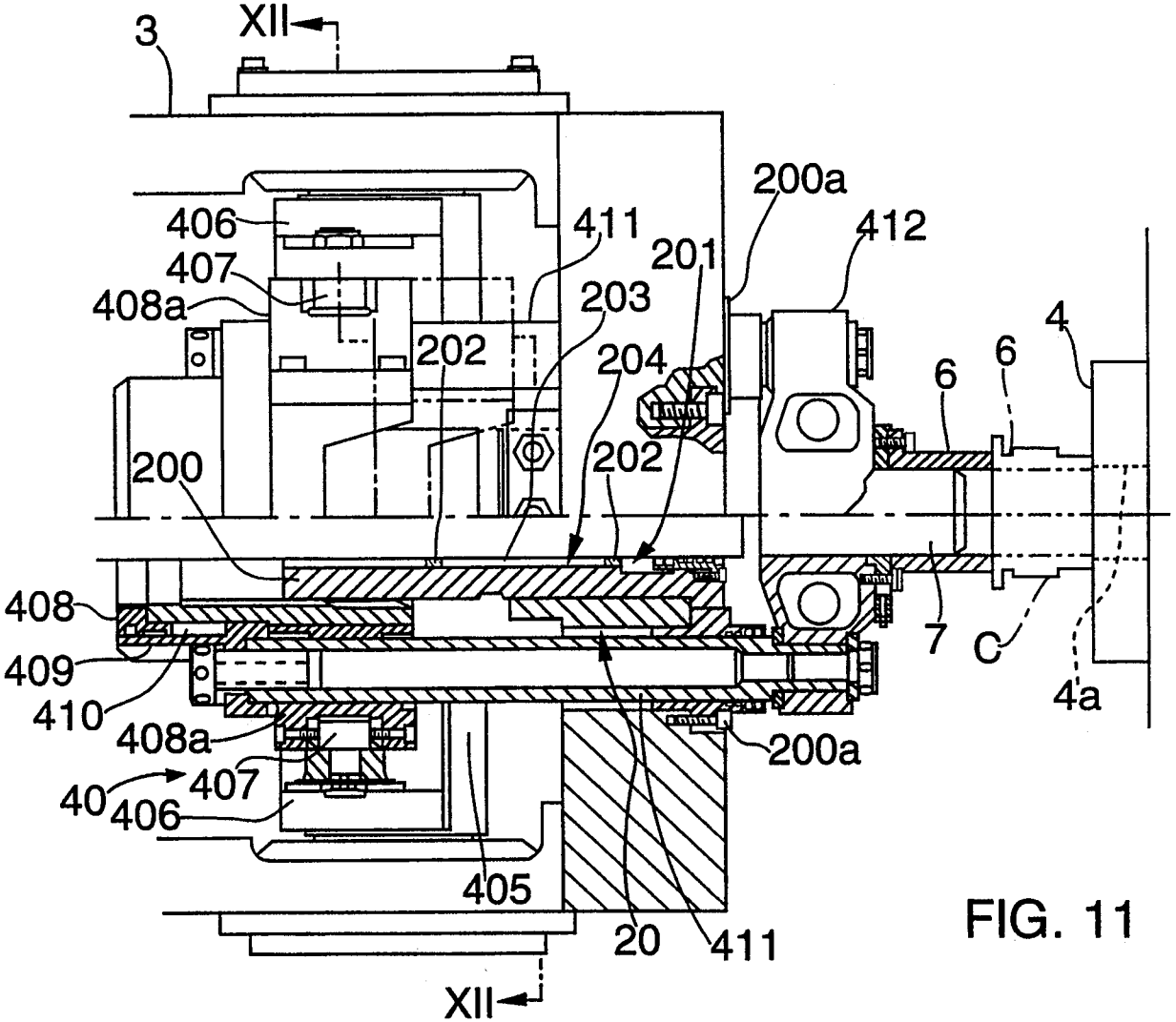
FIG. 11 is a plan view of a cup holder driving mechanism.

Referring to FIGS. 0 and 11, a can forming apparatus 1', according to an embodiment of the present invention, has a feeding mechanism 5 which feeds a cup-shaped can blank C into a stationary pocket 57. The stationary pocket 57 holds the can blank C in alignment with a cup holder 6 which is inserted into the can blank C. Cup holder 6 locates the can blank C, holding it securely while moving it into alignment with a die bore 4*a* in a die 4. An elongated punch 7 is driven into the cup holder 6 and into the bore 4*a* of the die 4 to effect deep drawing and ironing of the can blank C.

Figure 5:
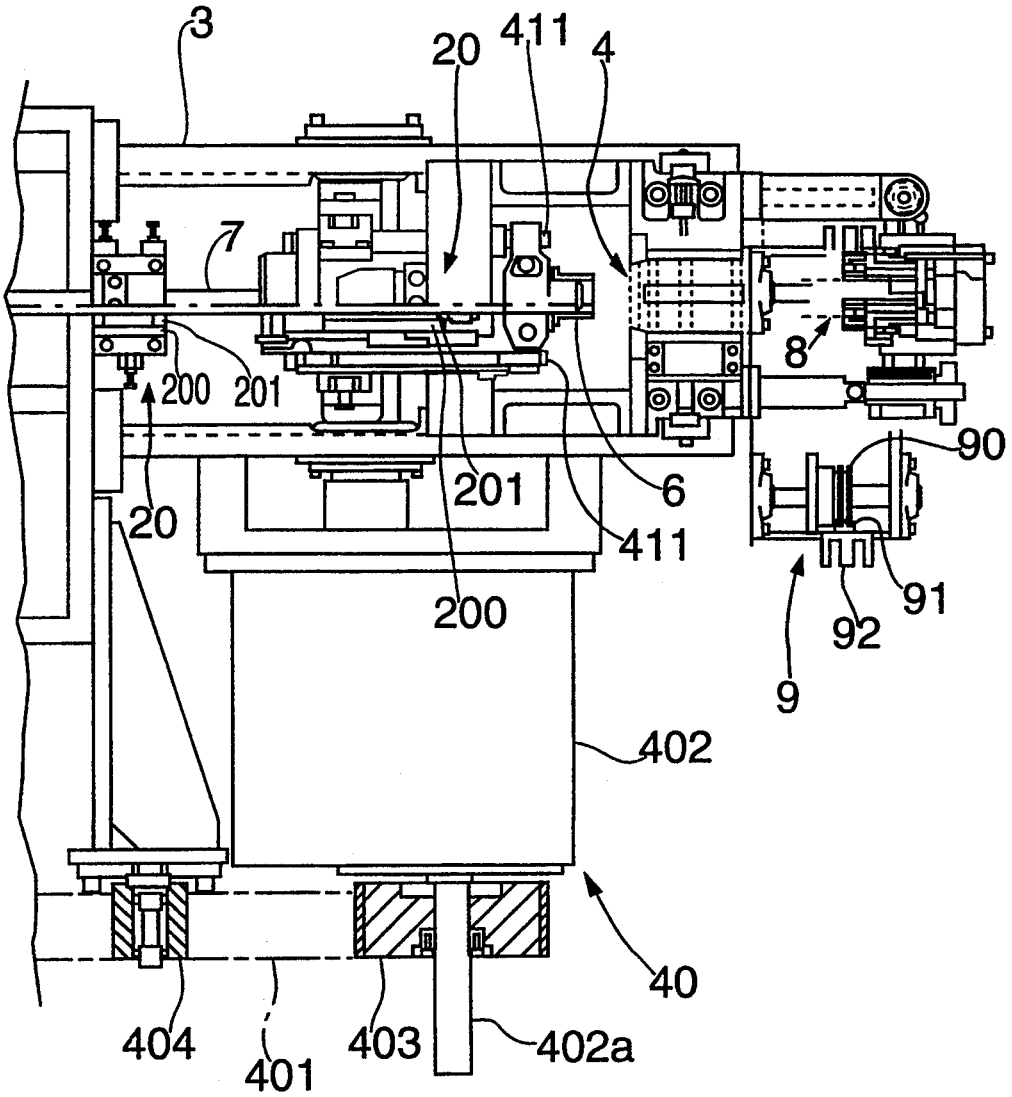
FIG. 5 is a plan view of the front part of the can forming apparatus according to an embodiment of the present invention.
Figure 6:
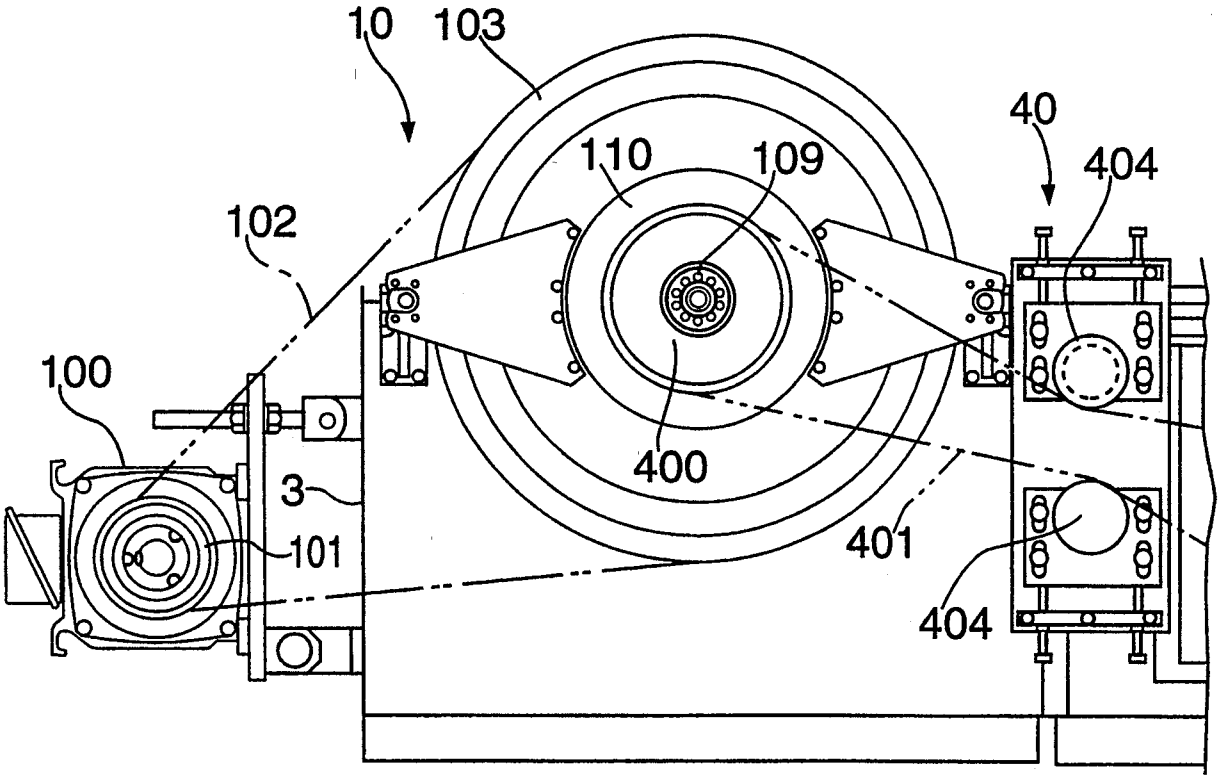
FIG. 6 is a side view of rear part of the can forming apparatus shown in FIG. 4.
Figure 9:
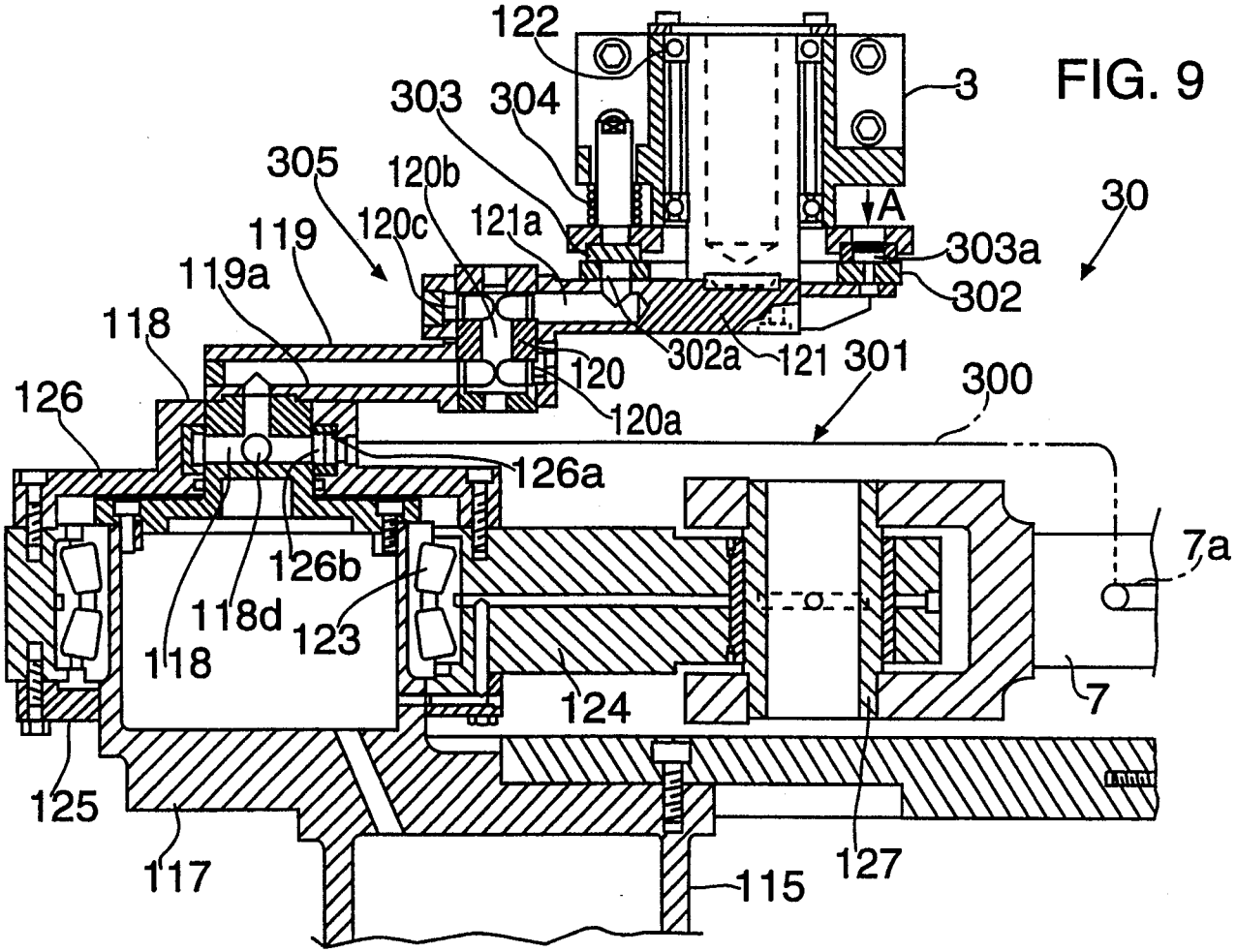
FIG. 9 is a cross section of a gas discharge mechanism.

Referring to FIGS. 5 and 9, a can bottom anvil 8 opposing the punch 7 cooperates with the punch 7 in forming the bottom of a can. A delivery mechanism 9, removes a finished can body B.

Figure 8:
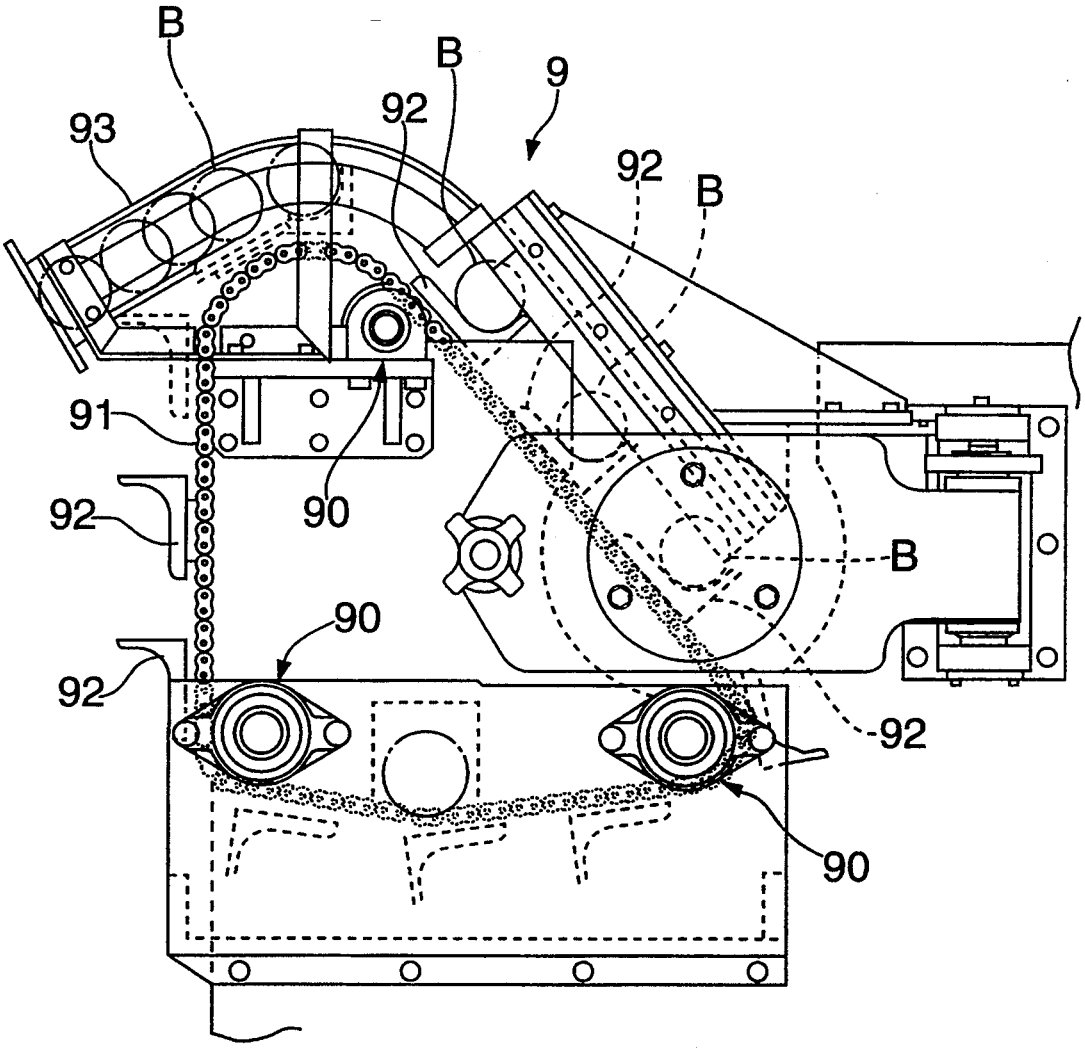
FIG. 8 is a front view of the can delivery mechanism, part of which is also shown in FIG. 5.

The delivery mechanism 9 is more completely shown in FIG. 8.

Figure 4:
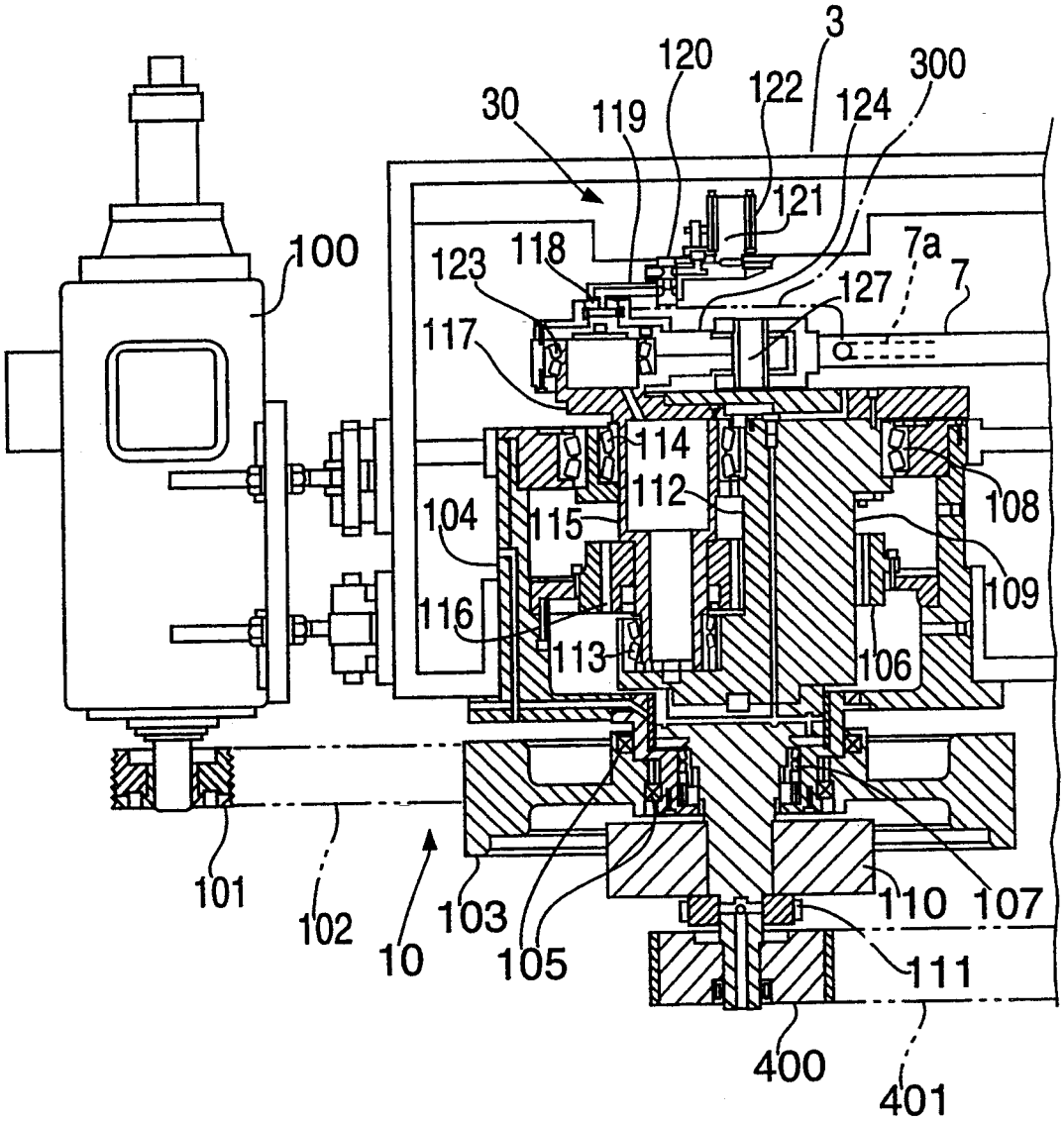
FIG. 4 is a plan view of the rear part of the can forming apparatus according to an embodiment of the present invention.

Referring now also to FIGS. 4, 6, 9, 11 and 12, a punch driving mechanism 10 moves the punch 7 in a reciprocating fashion. A punch bearing mechanism 20, visible in FIG. 11 and 12, supports and guides the reciprocating punch 7. Referring to FIGS. 4 and 9, a gas discharge mechanism 30 for conveying pressurized gas to, and discharging gas from, a gas blow-off hole 7*a* (FIGS. 4 and 9) in the punch 7 separates the can body B from the end of the punch 7. A motor 100, shown in FIGS. 4 and 6, drives both the cup holder driving mechanism 40 and the punch driving mechanism 10. A reciprocating movement of the cup holder 6, which aligns the cup holder 6 with the die bore 4*a*, is synchronized with that of the punch 7.

Referring again to FIG. 0, a can forming apparatus 1' includes a feeding mechanism 5 having a chute 50 which extends vertically to allow a blank C to drop freely. A pair of feed guides 51, 52 are disposed on a lower end of the chute 50 located partly in the path of feed. The feed guides 51, 52 are rotated by respective feed guide shafts 53, 54 in opposite directions.

Figure 2:
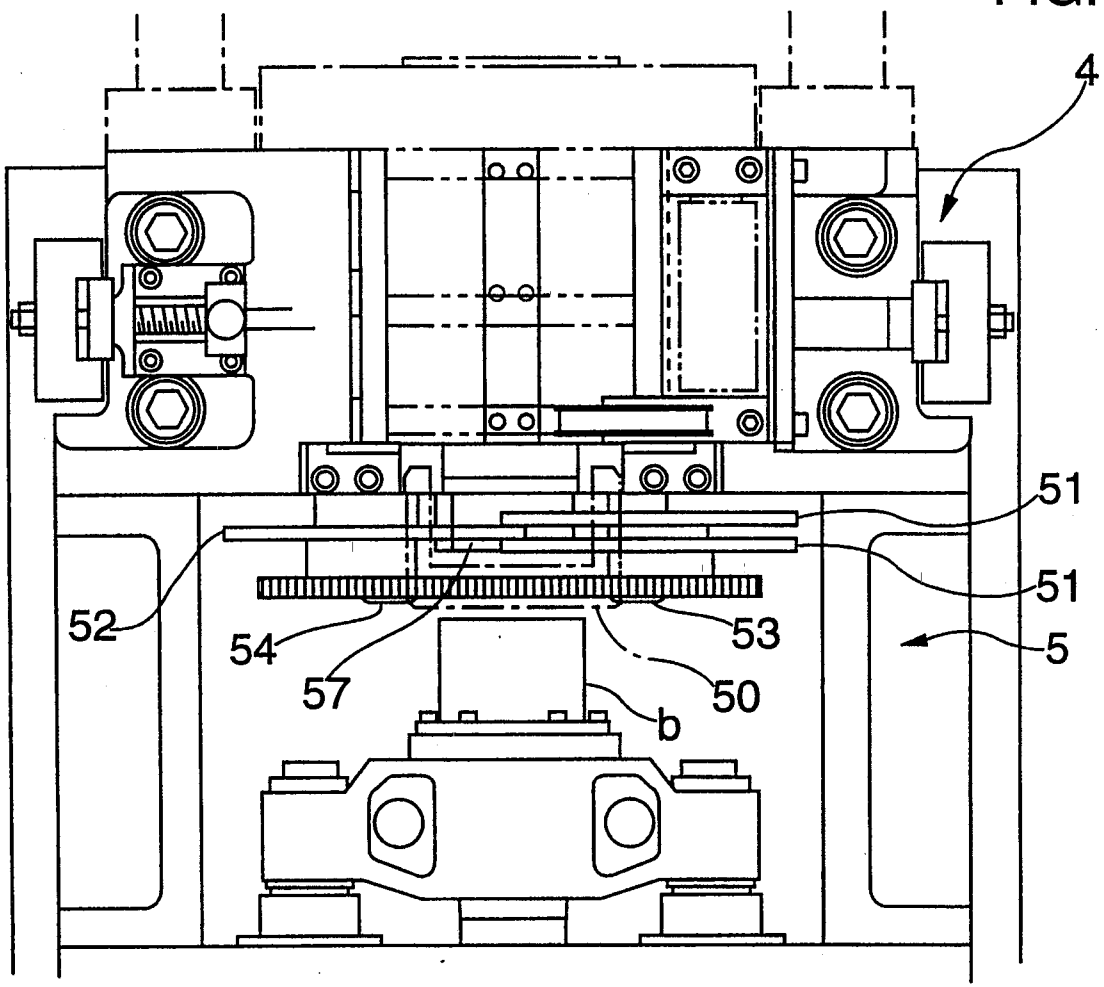
FIG. 2 is a plan view of the feeding mechanism of FIGS. 0 or 1, (rollers or leaf springs not shown) the front being to the left of the drawing.

Referring now to also FIG. 2, the three interdigitating feed guides 51, 52 have axes parallel to each other. The feed guide 52 is partly received in a space between a pair of coaxial feed guides 51.

Referring again to FIG. 0, a pair leaf springs 60, 61 are located downstream of the feed guides 51, 52 partly in the path of feed. The leaf springs 60, 61, which are mounted by fixed plates 60*c*, 61*c*, have outwardly rounded ends 60*b*, 61*b* urged into the path of feed by tabular springs 60*a*, 61*a*.

Figure 1:
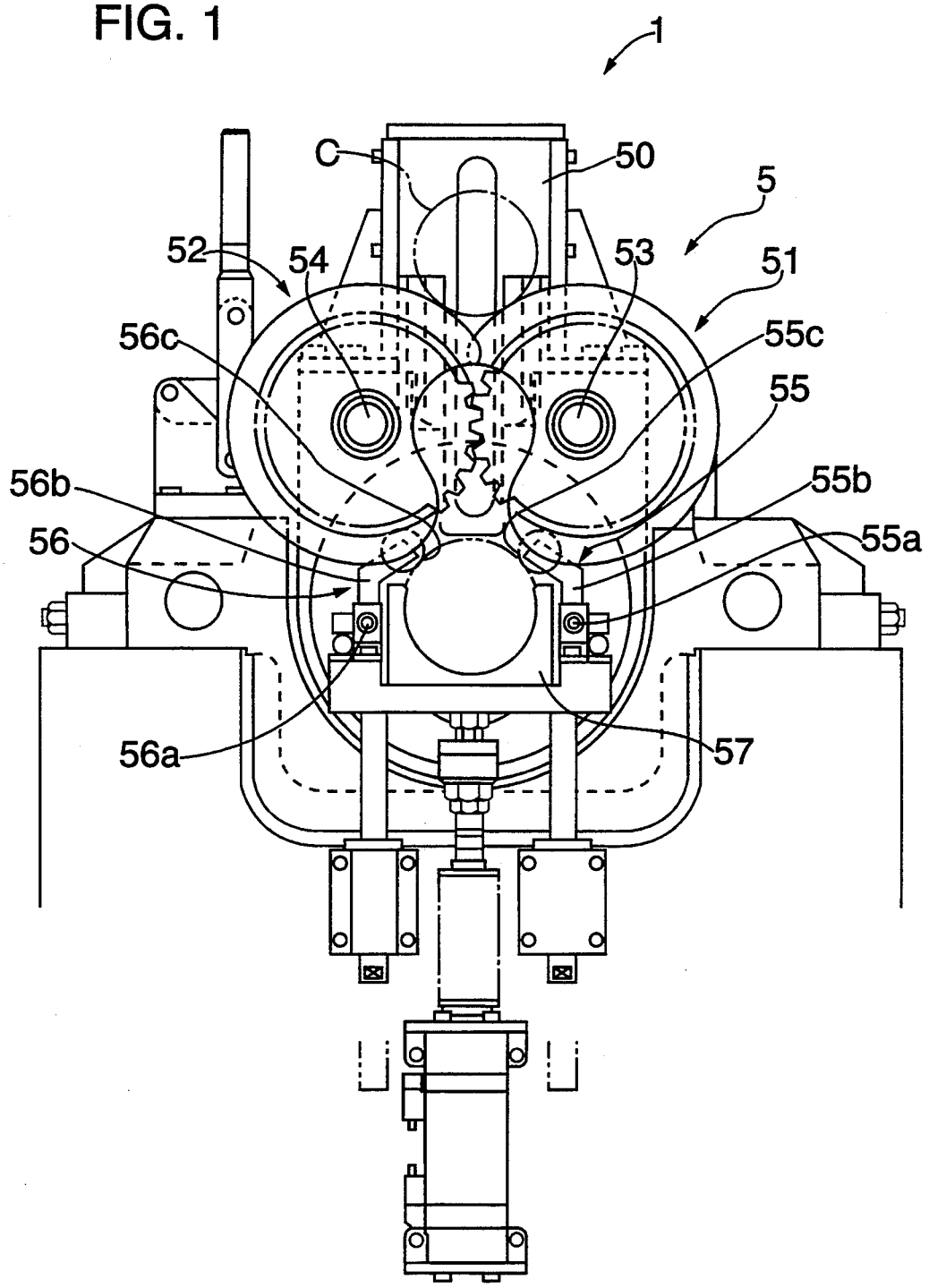
FIG. 1 is a front view of a feeding mechanism according to an embodiment of the present invention which employs rollers.

Referring now to FIG. 1, an alternative embodiment of the feeding mechanism 5 of FIG. 0 substitutes rollers 55, 56 for leaf springs 60, 61. The rollers 55, 56 include roller bodies 55*c*, 56*c* rotatably affixed on the ends of arms 55*b*, 56*b*. Rollers 55, 56 are urged by torsion coiled springs 55*a*, 55*a*, or urging means, to project into the path of feed. This alternative embodiment is identical to that of FIG. 0 except for the substitution of the rollers 55, 56 for the leaf springs 60, 61.

Referring now to FIGS. 3*a* through 3*h*, each of the feed guides 51, 52 has a substantially circular arcuate portion 51*c*, 52*c*, a recess 51*a*, 52*a*, and a radially extended portion 51*b*, 52*b*. As shown in FIGS. 3*b* through 3*e*, the recesses 51*a*, 52*a* cooperatively embrace the can blank C as the feed guides 51, 52 are rotated, thereby feeding the can blank C along the path of feed.

Figure 3A:
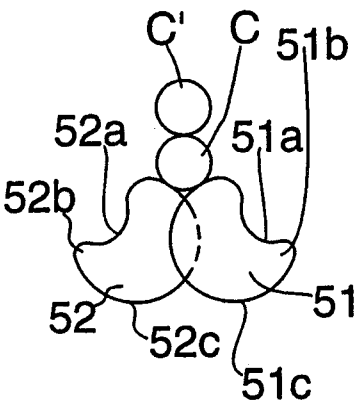
FIGS. 3*a* through 3*h* are schematic diagrams showing successive positions of feed guides of the feeding mechanism of FIG. 0 or 1.
Figure 3B:
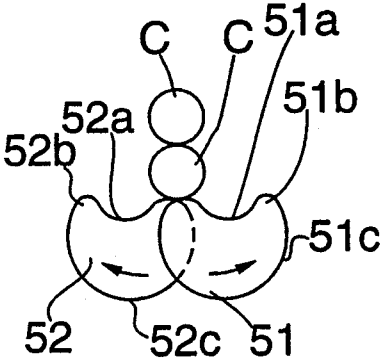
Figure 3C:
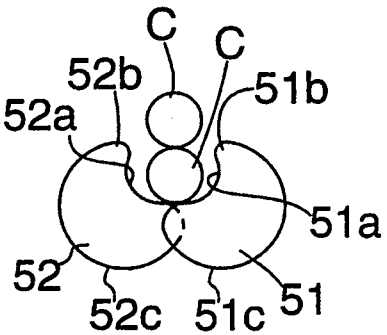
Figure 3D:
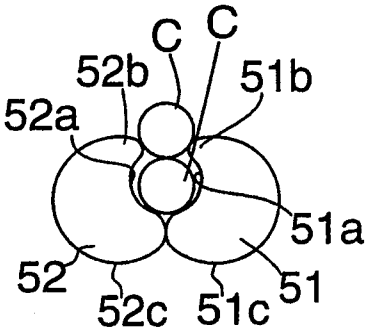
Figure 3E:
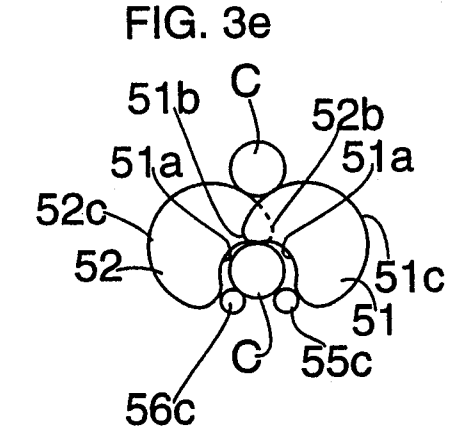
Figure 3F:
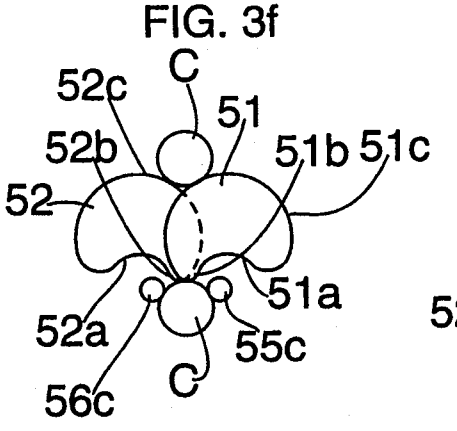
Figure 3G:
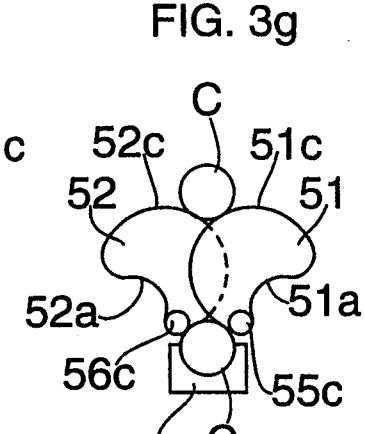
Figure 3H:
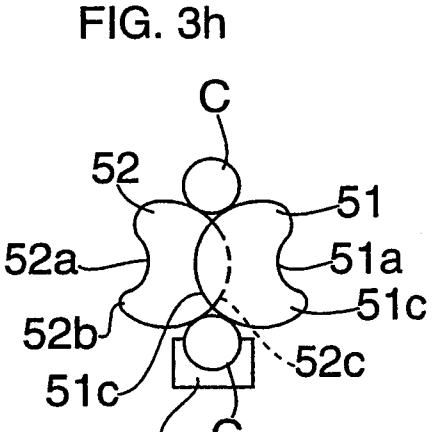

Referring now to FIGS. 3*e*–3*g*, as the feed guides are rotated further, the radially extended portions 51*b*, 52*b* force the can blank C against and through the rollers 55*c*, 56*c* and into the stationary pocket 57. At the same time, the arcuate portions 51*c*, 52*c* of the feed guides 51, 52, support the next can blank C' waiting in the chute 50.

The feeding mechanism 5 separates successive can blanks C and smoothly feeds the can blanks C one-by-one without allowing the can blanks C to drop freely. Thus, the leading can blank C is gently received in the stationary pocket 57, avoiding collision of the can blank C with stationary parts of the apparatus. Such collisions would otherwise damage the can blanks, as in the conventional feeding mechanism which allows the can blank C to drop freely. Furthermore, noise is remarkably reduced.

Referring now to FIGS. 5 and 8, finished can bodies are removed, after processing, by a can body removal mechanism 9. The can body removal mechanism 9 has an endless chain 91 wound around a plurality of sprockets 90. A plurality of L-shaped can body support members 92 are attached along an outer side of the endless chain 91 at predetermined intervals to carry and lift the can bodies B obliquely upward and away from the can bottom anvil 8. A discharge chute 93 receives the can body B from the can body support member 92.

Referring now to FIG. 4, the punch driving mechanism 10 includes the motor 100 which is mounted on one end of the stationary frame assembly 3. The axis of the motor 100 extends in the vertical direction. A pulley 101 is mounted on an output shaft of the motor 100. A fly-wheel 103 is drivingly connected to the pulley 101 by a belt 102. The fly-wheel 103 is rotatably carried by a bearing 105 in a small-diameter end of a stationary cylinder 104 attached to the frame assembly 3.

An internally toothed ring gear 106 is secured to an inner surface of an intermediate portion of the stationary cylinder 104. A rotary shaft 109 has diameter which increases step-wise from a small-diameter end toward a large-diameter base end. A bearing 107 in the small-diameter end of stationary cylinder 104 supports rotary shaft 109 at that location. A bearing 108 in the large-diameter end of stationary cylinder 104 supports rotary shaft 109 at a second location.

A pinion receiving portion 112 is formed in the large diameter end of the rotary shaft 109. A hollow pinion carrier 115 is rotatably mounted in the pinion receiving portion 112 on a pair of pinion bearings 113, 114. A pinion 116, attached to the pinion carrier 115, meshes with the ring gear 106. The pinion 116 has a pitch circle diameter which is equal to the pitch circle radius of the ring gear 106.

Referring now to FIGS. 4 and 9, the connecting rod 124 is rotatably carried by the pitch circle extension portion 117 through connecting rod bearing 123. A pair of sliding members 125, 126 are attached to the connecting rod 124 to make sliding contact with the pitch circle extension portion 117 and the pitch circle supporting shaft 118, respectively. The punch 7 is rotatably connected at its base end to the end of the connecting rod 124 via a hollow pin 127.

The pitch circle extension portion 117 is formed on an end of the pinion carrier 115 extending from the pitch circle of the pinion 116 along the axis of the pinion 116. A pitch circle support shaft 118 is secured to the end of the pitch circle extension portion 117. A connecting rod 119 extends to the axis common to the pinion 116 and the pinion carrier 115. Connecting rod 119 is secured to the pitch circle supporting shaft 118. A connecting pin 120 is rotatably secured to the end of the connecting rod 119 at the common axis of the pinion 116 and the pinion carrier 115. The connecting pin 120 is coaxial with the pinion carrier 115 and the pinion 116.

Referring to FIG. 4, the operation of the punch driving mechanism which causes reciprocating linear motion of the punch 7 is as follows. Rotation of the output shaft of the motor 100 is transmitted to the fly-wheel 103 through the pulley 101 and the belt 102. In normal operation of the apparatus, the rotary shaft 109 is drivingly connected to the fly-wheel 103 through the clutch brake 110. Rotation of the fly-wheel 103 is transmitted to the rotary shaft 109, so that the rotary shaft 109 rotates on the pinion bearings 113, 114. Consequently, the pinion carrier 115, which is rotatably mounted in the pinion receiving portion 112 of the rotary shaft 109 through pinion bearings 113, 114, as well as the pinion 116, which is carried by the pinion carrier 115, revolve about the axis of the rotary shaft 109. The pinion 116, which is held in meshing engagement with the internal gear teeth of the ring gear 106 fixed to the stationary cylinder 104, rotates about its own axis together with the pinion carrier 115 which carries the pinion 116. As a result, the pitch circle supporting shaft 118, which is secured to the end of the pitch circle extension portion 117 projecting from the base end of the pinion carrier 115, moves in reciprocating fashion. The stroke of the pitch circle supporting shaft 118 is equal to the diameter of the pitch circle of the ring gear 106. The pitch circle supporting shaft 118 is rotatably connected to the connecting rod 124 by the connecting rod bearing 123. Thus, the hollow pin 127, and the punch 7 connected thereto, are made to move in reciprocating fashion.

The clutch brake 110, mounted on the rotary shaft 109, selectively transmits torque between the fly-wheel 103 and the rotary shaft 109. The clutch brake 110 disconnects the fly-wheel 103 from the rotary shaft 109 and applies a brake when pressurized gas is relieved from a pressurized gas manifold 111 adjacent to the clutch brake 110.

Referring now to FIGS. 14 to 17, the relationships between the ring gear 106, the pinion 116 meshing with the internal teeth of the ring gear 106, and the pitch circle supporting shaft 118 are shown during operation. The pinion 116 has a pitch circle diameter equal to the pitch circle radius of the ring gear 106. As the pinion 116 revolves, it goes through the intermediate positions shown in FIGS. 14 through 17 in succession and back to the position shown in FIG. 14. Therefore, a point P on the pitch circle of the pinion 116 moves along the pitch circle diametrical line D from the left end to the right end and back. Thus, as viewed in FIGS. 14 to 17, point P moves in reciprocating linear motion, as the pinion 116 revolves along the inner periphery of the ring gear 106 while rotating around its own axis.

As the pinion 116 completes one full revolution along the inner periphery of the ring gear 106, the point P on the pitch circle of the pinion 116 makes one full rotation about the axis of the pinion 116 and a single full reciprocating linear motion. As the pinion 116 rotates about its own axis, the pitch circle supporting shaft 118 also rotates about the same axis.

Referring now to FIG. 9, as a result of the revolution of the pitch circle supporting shaft 118, the connecting rod 124, which is rotatably connected to the pitch circle supporting shaft 118 through connecting rod bearing 123, moves in reciprocating fashion while allowing smooth rotation of the pitch circle supporting shaft 118 through connecting rod bearing 123. Thus, the punch 7 which is connected to the connecting rod 124 through the hollow pin 127 quickly moves reciprocatingly and linearly without oscillation transverse to the axis thereof. The punch 7 thereby is inserted smoothly into the die bore **4*a* of the die 4**, thus enabling high-speed production of the can body B.

Referring to FIGS. 4 and 9, one end of the connecting rod 119, which is attached to the pitch circle supporting shaft 118, is rotatably connected to connecting pin 120 at the axis of the pinion 116 and the pinion carrier 115. The connecting pin 120 is rotatably connected to one leg of an L-shaped rotary member which is rotably connected to the stationary frame 3, via the rotary member bearing 122, at the axis of the ring gear 106 and the rotary shaft 109. The base end of the L-shaped rotary member 121 is coaxial with the rotary shaft 109. The rotation of the circle supporting shaft 118, imparts rotational movement about the axis of the pinion 116 and the pinion carrier 115. The revolution of the end of the connecting rod 119 about the axis of the ring gear 106 and the rotary shaft 109 in turn imparts rotation to the L-shaped rotary member 121, via the connecting pin 120, around the common axis of the ring gear 106 and the rotary shaft 109.

Figure 12:
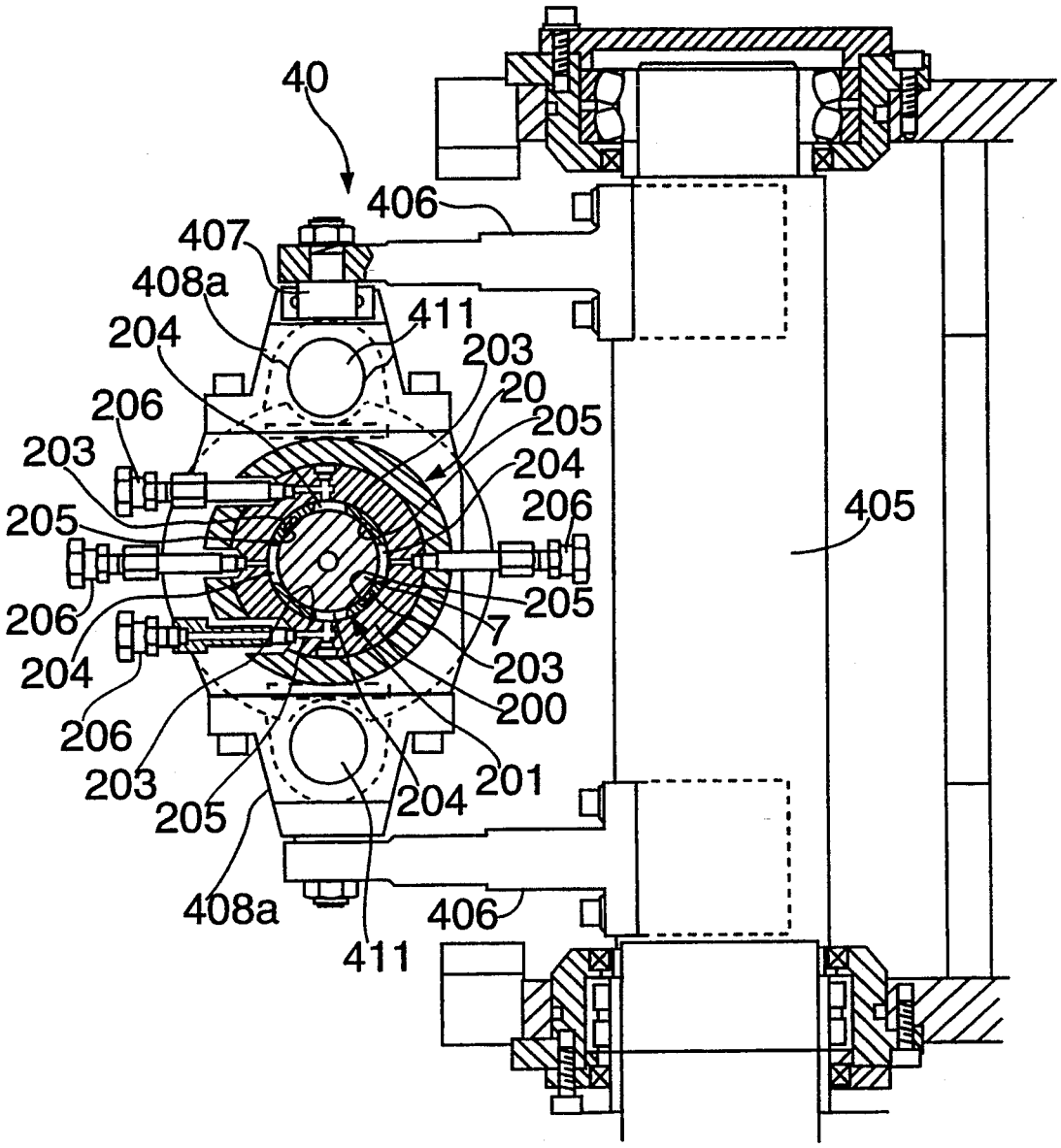
FIG. 12 is a sectional view taken along line XII—XII of the cup holder driving mechanism of FIG. 11.
Figure 13:
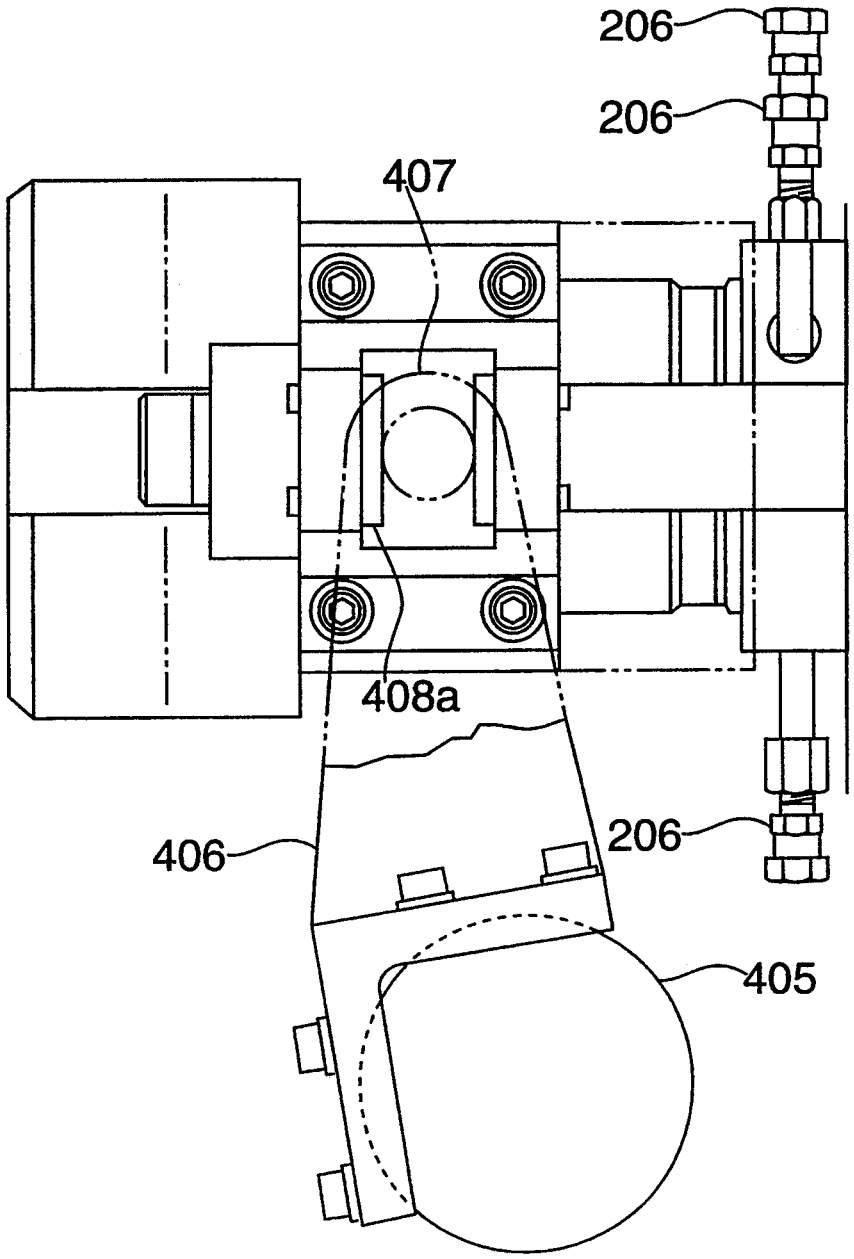
FIG. 13 is a front view of part of the cup holder driving mechanism of FIG. 11.
Figure 14:
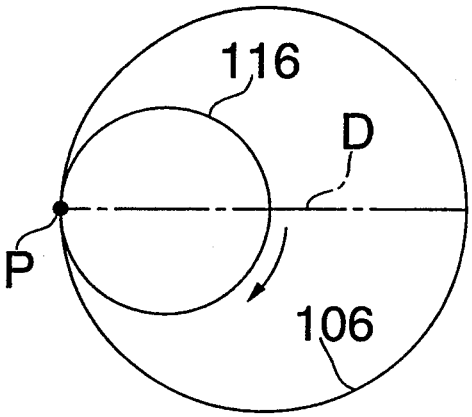
FIG. 14 is an illustration of the relationship between a ring gear and a pinion.
Figure 16:
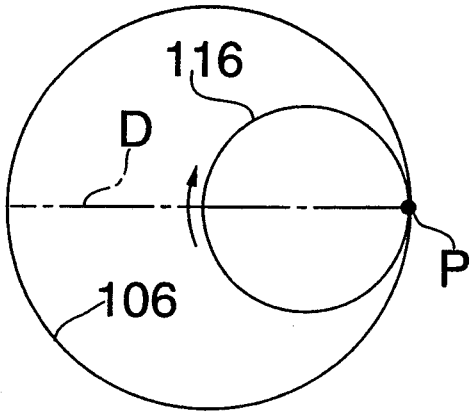
FIG. 16 is an illustration of the pinion revolved through 180° from the position shown in FIG. 14.
Figure 15:
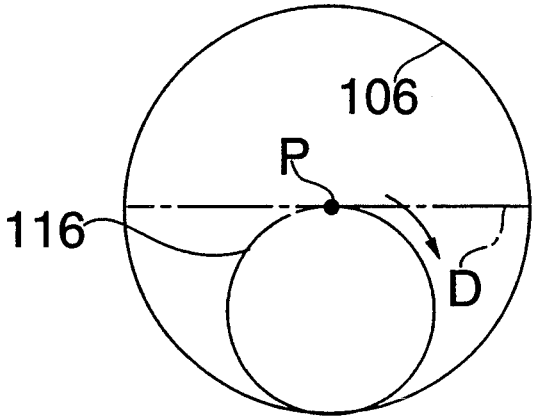
FIG. 15 is an illustration of the pinion revolved through 90° from the position shown in FIG. 14.
Figure 17:
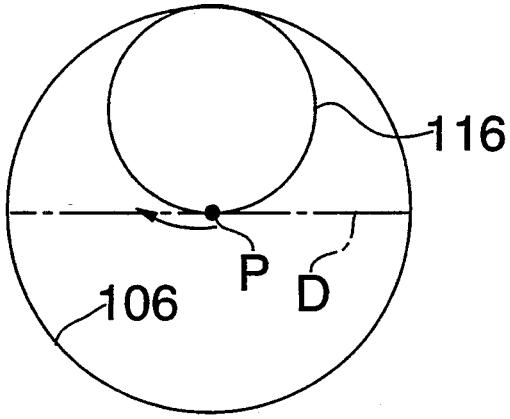
FIG. 17 is an illustration of the pinion revolved through 270° from the position shown in FIG. 14.
Figure 18:
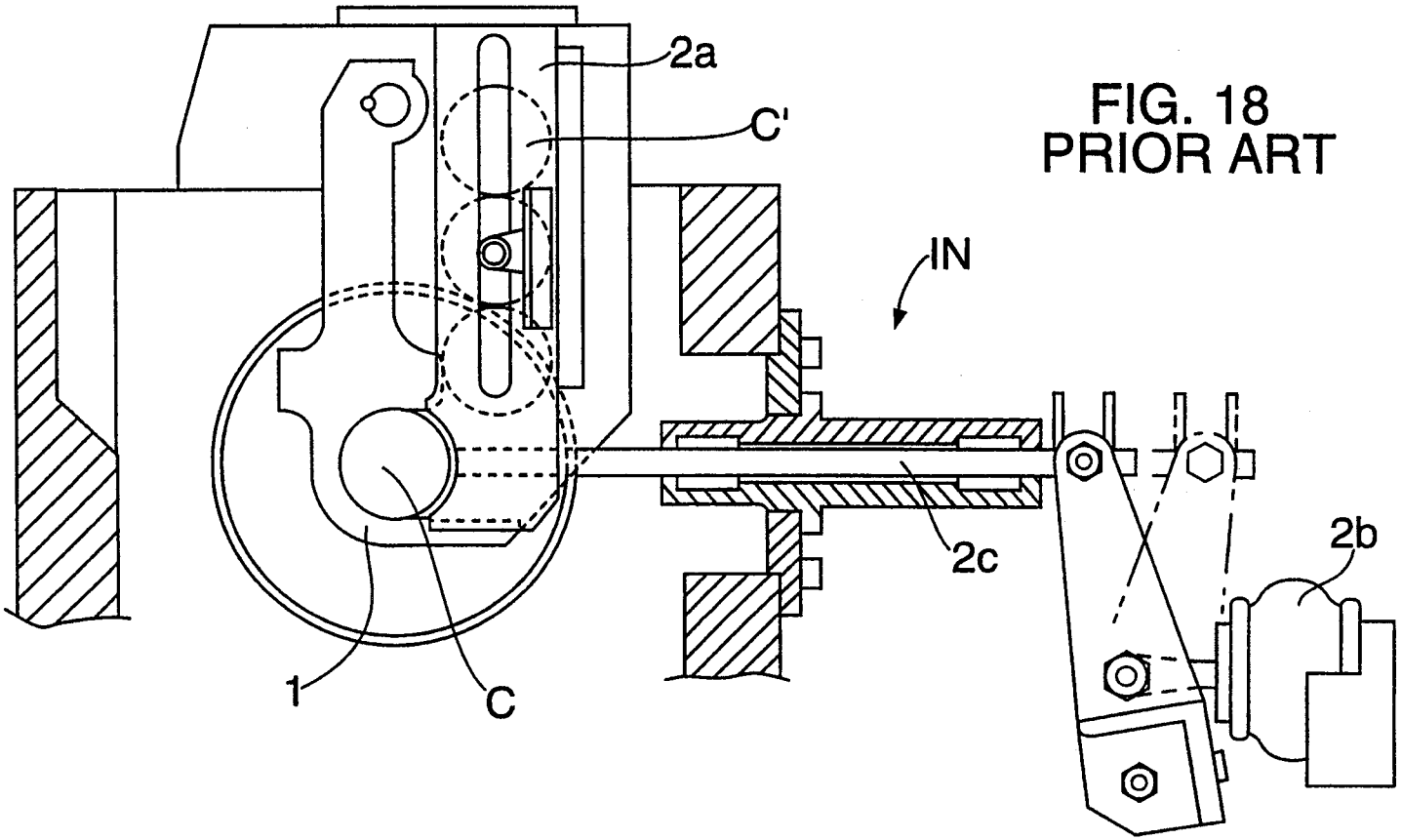
FIG. 18 PRIOR ART
FIG. 18 is a side view of a feeding mechanism according to the prior art.

Referring to FIGS. 11 and 12, the punch shaft bearing mechanism 20, includes liquid bearings, or hydrostatic bearings attached to the stationary frame assembly 3. A stationary cylinder 200 receives a bearing cylinder 201 therein. A bearing cylinder 201 is an integrated member composed of a pair of annular ends 202 spaced a predetermined distance from each other by four interconnecting portions 203. The annular ends 202 and four interconnecting portions 203 cooperate in defining four rectangular pressure ports 204. Draining grooves 205 are formed on the inner surfaces of the interconnecting portions 203. The pressure ports 204 receive a pressurized fluid from liquid supply connectors 206 which are mounted on the stationary cylinder 200.

Figure 10:
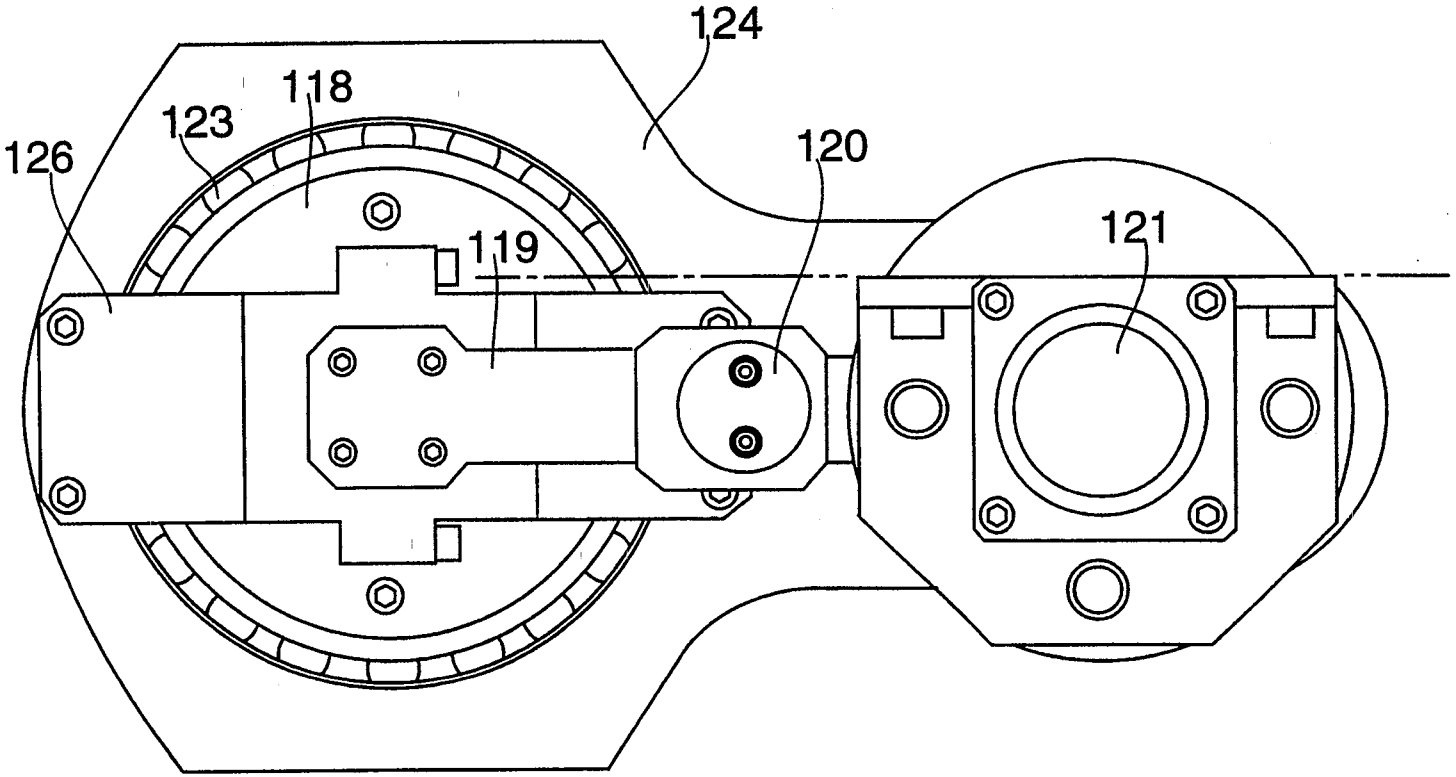
FIG. 10 is a plan view of the gas discharge mechanism of FIG. 9.

Referring now to FIGS. 9 and 10, the gas blow off mechanism 30 includes a tube 300 connected at one end to the base end of the gas blow-off hole **7*a* of the punch 7. The other end of the tube 300 is connected to a tube mounting hole 126*a* in the sliding member 126 adjacent to the pitch circle support shaft 118. The tube mounting hole 126*a* communicates with an internal bore 118*a* in the pitch circle supporting shaft 118, via an annular space 126*b* in the pitch circle supporting shaft 118. The internal bore 118*a* is made up of an inlet portion parallel to the axis of the pitch circle supporting shaft 118 and an outlet portion communicating with the inlet portion and the annular space 126*b* in the sliding member 126. The tube 300, the tube mounting hole 126*a* of the sliding member 126, and the annular space 126*b*, in cooperation, form a gas communication means 301 which provides communication between the gas blow-off hole 7*a* and the internal bore 118*a* of the pitch circle supporting shaft 118**.

Referring now to FIG. 9, a communication bore 119*a* in the connecting rod 119 communicates with the inlet bore of the internal bore 118*a* of the pitch circle supporting shaft 118. An H-shaped communication bore 120*b* in connecting pin 120 communicates with the communication bore 119*a* via an annular recess 120*a* in the connecting pin 120. A hook-shaped communication bore 121*a*, in the L-shaped rotary member 121, communicates with the H-shaped communication bore 120*b* via an annular recess 120*c* in the connecting pin 120. The hook-shaped communication bore 121*a* is connected to a communication bore 302*a* in a ring member 302 which is attached to the L-shaped rotary member 121. A gas communication passage 305 is formed by the combination of the communication bore 119*a*, the annular recess 120*a*, the H-shaped communication bore 120*b*, the annular recess 120*c*, the communication bore 121*a* and the communication bore 302*a*.

The ring member 302 is slidably mounted on a ring shaped sliding member 303. The ring shaped sliding member 303 is urged by a spring 304 located on the stationary frame assembly 3, against the ring member 302. The communication bore 302*a* of the ring member 302 communicates with a gas supply port 303*a* in the ring shaped sliding member 303 only at times when the above-mentioned ring member 302 and the L-shaped rotary member 121, are at a predetermined angular or rotational position or phase. A gas supply source A is connected to the gas supply port 303*a*.

During operation, the ring shaped sliding member 303 is held securely in pressure contact with the ring member 302 by the force exerted by the spring 304. A tight seal is formed between the connecting pin 120 and adjacent members including the L-shaped rotary member 121 and the connecting rod 119, as well as between the pitch circle supporting shaft 118 and the sliding member 126. Consequently, the gas from the gas supply source A, does not leak before reaching the gas blow-off hole 7*a*, notwithstanding the motions of the individual members such as the ring member 302 and the L-shaped rotary member 121, connecting pin 120, connecting rod 119, pitch circle supporting shaft 118 and the sliding member 126. The gas therefore is discharged through the gas blow-off hole 7*a* of the punch 7 at the proper times to displace a formed can. The tube 300 provides communication only between the sliding member 126 and the punch 7, which perform synchronized reciprocating linear motion, so that the tube 300 is firmly secured and not prone to damaged despite the high-speed motion of the punch 7, thus ensuring stable operation of the apparatus over an extended period.

Figure 7:
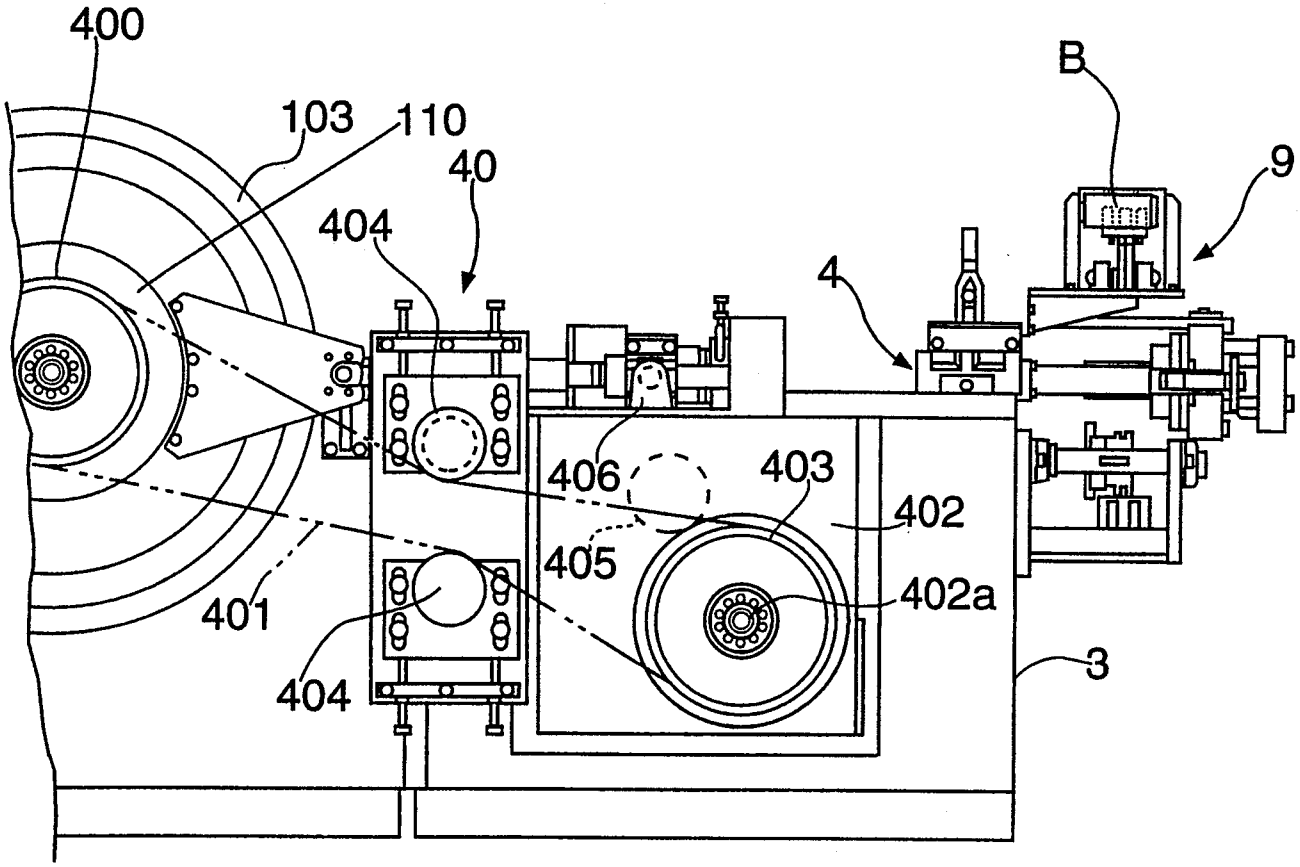
FIG. 7 is a side view of front part of the can forming apparatus shown in FIG. 5.

Referring to FIGS. 7 and 11, the cup holder driving mechanism 40 includes a pulley 400 carried by an end of the rotary shaft 109, and an input shaft pulley 403 mounted on an input shaft 402*a* of a cam box 402. Cam box 402 has a double cam mechanism. The input shaft pulley 403 is drivingly connected to the pulley 400 via a belt 401. A pair of tension rollers 404 allow adjustment of the tension of the belt 401. A pivot shaft 405 is pivotable through a predetermined angle on the output side of the cam box 402. A roller 407 is mounted on each end of the pivot shaft 405 by connecting members 406. An inner movable cylinder 408 includes roller support portions 408*a* rotatably supporting the rollers 407 movably on the outer periphery of the stationary cylinder 200 of the punch bearing mechanism 20 adjacent to the end of the punch 7. The inner movable cylinder 408 is free to slide within the outer movable cylinder 409. A pressurized chamber 410 is defined between movable cylinder 408, 409. A predetermined internal liquid pressure is maintained in pressurized chamber 410. A pair of supporting bars 411 are slidably supported by the roller support portions 408*a* and the supporting bar sliding portions 200*a* of the stationary cylinder 200 and front carriage 412 which are connected to ends of the supporting bars 411. The cup holder 6 is attached to the front carriage 412.

Referring now to FIGS. 4 and 5, the rotation of the rotary shaft 109 is transmitted to the input shaft 402*a* through the pulley 400, belt 401 and the input shaft pulley 403 of the aforementioned cup holder driving mechanism 40.

Referring to FIGS. 11 and 12, the rollers 407 on connecting members 406 pivot through a predetermined angular range about a pivot shaft 405. The rocking motion of the rollers 407, through roller support portions 408*a* holding rollers 407, cause the inner movable cylinder 408 to slide back and forth along the stationary cylinder 200 of the punch bearing mechanism 20. This sliding motion causes the outer movable cylinder 409 to move in the same direction as the movement of the inner movable cylinder 408 due to the force exerted by fluid in the pressurized chamber 410. A pair of supporting bars 411 secured to the outer movable cylinder 409 are thus made to slide while supported by the roller support portions 408*a* and the supporting bar sliding portions 200*a* of the stationary cylinders 200.

Referring to FIG. 12, during the reciprocating linear motion of the punch 7, a pressurized liquid is supplied into four rectangular pressure ports 204 from four liquid supply connectors 206 through the stationary cylinders 200 of the punch bearing mechanism 20. The supply of pressurized liquid keeps the punch 7 hydrodynamically separated from the inner surface of the bearing cylinder 201, thereby virtually eliminating friction between the punch and the bearing cylinder 201, while smoothly guiding the reciprocating linear motion of the punch 7.

Referring again to FIGS. 4 and 5, the sliding movement of the supporting bars 411 causes the front carriage 412, secured to the ends of the supporting bars 411, to move toward and away from the die 4. Consequently, the cup holder 6, attached to the front carriage 412, is inserted into the can blank C placed in the bore 4*a* of the die 4. The cup holder 6 is moved close enough to the die to clamp the cup-shaped can blank C against the die. The can blank C is thereby located and fixed between the cup holder 6 and the die 4, to prepare for the deep drawing and ironing on the can blank C in the bore 4*a* of the die 4.

The rollers 407 on the upper ends of the pair of connecting members 406, which pivot on the pivot shaft 405, as well as the inner movable cylinder 408, connected through the roller supporting portions 408*a* holding the rollers 407, are positioned slightly ahead of the positions corresponding to the forward stroke end of the cup holder 6. Thus the rollers 407 project slightly beyond these positions toward the die 4, when the cup-shaped blank C is held between the cup holder 6 and the die 4. In operation, however, the forward movement of the cup holder 6 is blocked by the cup-shaped blank C, so that the front carriage 412, which directly drives the cup holder 6, as well as the supporting bars 411 and the outer movable cylinder 409, are retracted relative to the inner movable cylinder 408, against the resilient pressing force generated in the pressurized chamber 410. Thus, the cup holder 6 firmly presses the can blank C against the die 4 due to the pressing force generated by the pressurized chamber 4. Thus, the can blank C is stably held in the desired position.

If the cup-shaped blank C has been set incorrectly inside the bore 4*a* of the die 4, an abnormally large pressing force is exerted on the cup holder 6 when the cup holder is brought into contact with the can blank C. This results in an abnormal rise in pressure within the pressurized chamber 410. In such a case, the pressure inside the pressurized chamber 410 is relieved, allowing the cup holder 6, front carriage 412, supporting bars 411 and the outer movable cylinder 409 to be retracted relative to the inner movable cylinder 408, thereby preventing damage to the cup holder 6 and tools including the die 4.

The process for forming a can body B by the can forming apparatus described above is as follows. A cup-shaped blank C is placed in alignment with the inner bore 4*a* of the die 4 from the upper side of the stationary frame assembly 3 by the feeding mechanism 5. The cup holder 6 is driven into the cup-shaped blank C by the cup holder driving mechanism 40, to locate and fix the can blank C in position. The punch 7, which is supported and guided by the pair of punch shaft bearing mechanisms 20, is driven by the punch driving mechanism into the cup holder 6 and into the bore 4*a* of the die 4, thereby effecting deep drawing and ironing on the can blank C. At the same time punch 7 presses the bottom of the can blank C against the can bottom anvil 8, forming the can body B. A gas, such as air, is then supplied by the gas discharge mechanism 30 through the gas blow-off hole 7*a* in the punch 7, thereby forcing the can body B off the end of the punch 7 in preparation for forming the next can body B. The endless chain 91 of the can body removal mechanism 9 is actuated so that the can body B is carried by the can body supporting member 92, lifting the can body B obliquely upward, where it is introduced to the discharge chute 93.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A feeding mechanism for feeding can blanks into alignment with a die bore of a can forming apparatus, comprising:

a stationary frame;

a plurality of feed guides, each having an axis, rotatably attached to said stationary frame;

said axes being substantially parallel;

means, attached to said stationary frame, for rotating said plurality of feed guides about respective ones of said axes of said feed guides; and said plurality of feed guides including means for consecutively holding, feeding along a path substantially perpendicular to said axes, and releasing a can blank.

2. A feeding mechanism as recited in claim 1, wherein:

said plurality of feed guides have substantially circular contours;

said plurality of feed guides are partly positioned in a path of feed of said can blank;

means for rotating said plurality of feed guides in opposite directions about respective ones of said axes of said feed guides;

said plurality of feed guides each includes a recess, which cooperatively embrace said can blank and subsequently release said can blank as said plurality of feed guides are rotated; and said plurality of feed guides each include a radially extended portion, continuous from said recesses which press said can blank away from said plurality of feed guides and along said path of feed upon said release of said can blank.

3. A feeding mechanism as recited in claim 2, further comprising:

means for supporting said can blank as said can blank is pressed by said radially extended portions;

said means for supporting being positioned along said path of feed from said plurality of feed guides; and means for resiliently urging said means for supporting to project into said path of feed.

4. A feeding mechanism as recited in claim 2, further comprising:

a stationary pocket attached to said stationary frame for receiving said can blank;

means for supporting said can blank as said can blank is pressed by said radially extended portions;

said means for supporting being positioned along said path of feed from said plurality of feed guides;

means for resiliently urging said means for supporting to project into said path of feed and for yielding as said can blank is forced past said extended portions;

said means for resiliently urging including means for positively engaging and forcing said cup into said stationary pocket and holding said can blank in said stationary pocket subsequent to said yielding.

5. A can forming apparatus for deep drawing and ironing a can blank comprising:

a stationary frame;

a plurality of feed guides, each having an axis, rotatably attached to said stationary frame;

said axes being substantially parallel;

means for rotating said plurality of feed guides about respective ones of said axes of said feed guides;

said plurality of feed guides including means for sequentially holding, feeding along a path substantially perpendicular to said axes, and releasing said can blank;

said plurality of feed guides further including means for placing said can blank in axial alignment with a die bore;

a punch; and means for producing reciprocating motion of said punch into said die bore.

6. A can forming apparatus as in claim 5, wherein said punch includes at least one gas blow-off hole.

7. A can forming apparatus as in claim 6, further comprising:

a stationary gas supplying means;

a movable element synchronized with motion of said punch and held in sliding contact with said stationary gas supplying means;

means for communicating gas from said movable element to said at least one gas blow-off hole in said punch; and means for permitting gas to pass from said stationary gas supplying means to said movable element only at at least one predetermined time in a cycle of can making.

8. A can forming apparatus as in claim 5, wherein:

said plurality of feed guides have substantially circular contours;

said plurality of feed guides are partly positioned in a path of feed;

means for rotating said plurality of feed guides in opposite directions about respective ones of said axes of said feed guides;

said plurality of feed guides each include a recess, which cooperatively embrace said can blank and subsequently release said can blank as said plurality of feed guides are rotated; and said plurality of feed guides each include a radially extended portion, continuous from said recesses, which press said can blank away from said plurality of feed guides and along said path of feed upon said release of said can blank.

9. A can forming apparatus as in claim 8, further comprising:

means for supporting said can blank as said can blank is pressed by said radially extended portions;

said means for supporting being positioned along said path of feed from said plurality of feed guides; and means for resiliently urging said means for supporting to project into said path of feed.

10. A can forming apparatus as recited in claim 9, wherein said punch includes at least one gas blow-off hole.

11. A can forming apparatus as recited in claim 10, further comprising means for discharging a gas through said at least one gas blow-off hole, thereby separating said can body from said punch.

12. A can forming apparatus as recited in claim 11, wherein said means for discharging includes:

a stationary gas supplying means;

a movable element synchronized with motion of said punch and held in sliding contact with said stationary gas supplying means;

means for communicating gas from said movable element to said at least one gas blow-off hole in said punch; and means for permitting gas to pass from said stationary gas supplying means to said movable element only at at least one predetermined time in a cycle of can making.

13. A can forming apparatus as recited in claim 9, wherein said means for producing reciprocating motion comprises:

a pinion gear having a first axis;

a ring gear having internal teeth;

said ring gear having a second axis;

said pinion gear having a pitch circle diameter;

said ring gear having a pitch circle radius;

said pitch circle diameter being equal to said pitch circle radius;

means for revolving said pinion gear along an inner periphery of said ring gear in meshing engagement with said internal teeth of said ring gear;

means for slidably supporting said punch; and means for rotatably supporting said punch on a point on said pitch circle diameter of said pinion gear.

14. A can forming apparatus as recited in claim 13, wherein said means for slidably supporting comprises a fluid bearing.

* * * * *